US011485938B2

(12) United States Patent
Dahl et al.

(10) Patent No.: US 11,485,938 B2
(45) **Date of Patent: *Nov. 1, 2022**

(54) MICROEMULSION COMPRISING QUATERNARY AMMONIUM COMPOUND, ESPECIALLY FOR PRODUCTION OF FABRIC SOFTENER FORMULATIONS

(71) Applicant: EVONIK OPERATIONS GMBH, Essen (DE)

(72) Inventors: Verena Dahl, Bergisch Gladbach (DE); Jochen Kleinen, Heinsberg (DE); Miyako Hisamoto, Glen Allen, VA (US); Jens Hildebrand, Johannesberg (DE); Alexandra Trambitas, Alzenau (DE); Erin King, Chesterfield, VA (US); Kristin Klostermann, Essen (DE); Iwona Winter, Mülheim an der Ruhr (DE); Simone Bräscher, Bad Orb (DE)

(73) Assignee: Evonik Operations GmbH, Essen (DE)

( * ) Notice: Subject to any disclaimer, the term of this patent is extended or adjusted under 35 U.S.C. 154(b) by 51 days.

This patent is subject to a terminal disclaimer.

(21) Appl. No.: 16/644,685

(22) PCT Filed: Sep. 6, 2018

(86) PCT No.: PCT/EP2018/074036

§ 371 (c)(1),
(2) Date: Mar. 5, 2020

(87) PCT Pub. No.: WO2019/048556

PCT Pub. Date: Mar. 14, 2019

(65) Prior Publication Data

US 2020/0283707 A1 Sep. 10, 2020

Related U.S. Application Data

(60) Provisional application No. 62/554,918, filed on Sep. 6, 2017.

(51) Int. Cl.

| | |
|---|---|
| ***C11D 17/00*** | (2006.01) |
| ***C11D 1/835*** | (2006.01) |
| ***C11D 3/00*** | (2006.01) |
| ***C11D 3/20*** | (2006.01) |
| ***C11D 3/30*** | (2006.01) |
| ***C11D 3/43*** | (2006.01) |

(52) U.S. Cl.
CPC ..... *C11D 17/0021* (2013.01); *C11D 1/835* (2013.01); *C11D 3/0015* (2013.01); *C11D 3/2093* (2013.01); *C11D 3/30* (2013.01); *C11D 3/43* (2013.01)

(58) Field of Classification Search
CPC ..... C11D 17/00; C11D 1/845; C11D 3/43
See application file for complete search history.

(56) References Cited

U.S. PATENT DOCUMENTS

| | | | | |
|---|---|---|---|---|
| 4,339,391 | A | 7/1982 | Hoffmann et al. | |
| 5,066,414 | A | 11/1991 | Chang | |
| 5,391,321 | A | 2/1995 | Gruning et al. | |
| 5,525,245 | A * | 6/1996 | Grandmaire | C11D 1/62 510/524 |
| 5,645,842 | A | 7/1997 | Gruning et al. | |
| 5,656,585 | A * | 8/1997 | Grandmaire | D06M 13/463 510/524 |
| 5,886,201 | A * | 3/1999 | Bonastre | A61K 8/45 554/110 |
| 6,432,895 | B1 | 8/2002 | Bigorra et al. | |
| 6,432,911 | B1 * | 8/2002 | Buron | C11D 1/645 510/525 |
| 6,958,410 | B2 | 10/2005 | Koch et al. | |
| 7,727,599 | B2 | 6/2010 | Doehler et al. | |
| 7,834,122 | B2 | 11/2010 | Ferenz et al. | |
| 8,183,199 | B2 | 5/2012 | Fossum et al. | |
| 8,557,944 | B2 | 10/2013 | Henning et al. | |
| 8,569,224 | B2 | 10/2013 | Kohle et al. | |
| 8,653,214 | B2 | 2/2014 | Venzmer et al. | |
| 8,658,581 | B2 | 2/2014 | Hloucha et al. | |
| 8,796,198 | B2 | 8/2014 | Henning et al. | |
| 8,883,713 | B2 | 11/2014 | Parrish et al. | |
| 8,920,786 | B2 | 12/2014 | Hloucha et al. | |
| 9,090,853 | B2 | 7/2015 | Holderbaum et al. | |
| 9,138,385 | B2 | 9/2015 | Dahl et al. | |
| 9,320,697 | B2 | 4/2016 | Kleinen et al. | |

(Continued)

FOREIGN PATENT DOCUMENTS

| | | |
|---|---|---|
| DE | 197 51 151 | 5/1999 |
| DE | 19755488 | 6/1999 |

(Continued)

OTHER PUBLICATIONS

WO 93/16157. Eng. Translation. (Year: 1993).*
DE10205223454. Eng. Translation. (Year: 2016).*
Wang, et al., "Carbohydrate-Modified Siloxane Surfactants and Their Adsorption and Aggregation Behavior in Aqueous Solution," *J. Phys. Chem. B* 114(20):6872-6877 (May 2010).
U.S. Appl. No. 16/650,344, filed Mar. 24, 2020, Trambitas.
Non Final Office Action for copending U.S. Appl. No. 16/650,344, dated Jun. 16, 2021.

(Continued)

*Primary Examiner* — Nicole M. Buie-Hatcher
*Assistant Examiner* — M. Reza Asdjodi
(74) *Attorney, Agent, or Firm* — Law Office of: Michael A. Sanzo, LLC

(57) ABSTRACT

The invention provides for the use of specific microemulsions comprising quaternary ammonium compounds for production of clear fabric softener formulations having improved performance properties, and also the corresponding formulations and a process for production thereof.

19 Claims, No Drawings

(56) References Cited

U.S. PATENT DOCUMENTS

| | | | | |
|---|---|---|---|---|
| 9,353,289 | B2 | 5/2016 | De Gans et al. | |
| 9,441,187 | B2 | 9/2016 | Köhle et al. | |
| 9,745,251 | B2 | 8/2017 | Klostermarm et al. | |
| 11,312,926 | B2 | 4/2022 | Trambitas et al. | |
| 2002/0010104 | A1* | 1/2002 | Ewbank | C11D 3/40 510/101 |
| 2004/0014627 | A1 | 1/2004 | Adams et al. | |
| 2004/0142838 | A1 | 7/2004 | Azuma et al. | |
| 2004/0142841 | A1 | 7/2004 | De Buzzaccarini et al. | |
| 2004/0163182 | A1* | 8/2004 | Nguyen | D21H 17/72 8/115.51 |
| 2006/0080786 | A1 | 4/2006 | Evers et al. | |
| 2006/0200914 | A1 | 9/2006 | Evers et al. | |
| 2006/0264352 | A1 | 11/2006 | Sajic et al. | |
| 2007/0160652 | A1 | 7/2007 | Mueller et al. | |
| 2007/0197678 | A1 | 8/2007 | Cavaleiro et al. | |
| 2008/0004357 | A1 | 1/2008 | Meyer et al. | |
| 2008/0305056 | A1 | 12/2008 | Jenni et al. | |
| 2009/0124533 | A1 | 5/2009 | Kottke et al. | |
| 2010/0104611 | A1 | 4/2010 | Chan et al. | |
| 2010/0184634 | A1 | 7/2010 | Henault et al. | |
| 2011/0239377 | A1 | 10/2011 | Fossum et al. | |
| 2013/0012423 | A1 | 1/2013 | Hloucha et al. | |
| 2013/0102520 | A1 | 4/2013 | Holderbaum et al. | |
| 2013/0217930 | A1 | 8/2013 | Haensel et al. | |
| 2015/0073069 | A1 | 3/2015 | De Gans et al. | |
| 2015/0297485 | A1 | 10/2015 | Kleinen et al. | |
| 2017/0009184 | A1* | 1/2017 | Schubert | C11D 3/001 |
| 2018/0133133 | A1 | 5/2018 | Kleinen et al. | |
| 2020/0299616 | A1 | 9/2020 | Trambitas et al. | |
| 2021/0277329 | A1 | 9/2021 | Neubauer et al. | |

FOREIGN PATENT DOCUMENTS

| | | | | |
|---|---|---|---|---|
| DE | 102015223454 | A1 * | 6/2016 | A61K 8/604 |
| EP | 1 972 330 | | 9/2008 | |
| EP | 2 301 987 | | 3/2011 | |
| JP | H11508291 | | 7/1999 | |
| JP | 2002-167437 | | 6/2002 | |
| JP | 2002201494 | | 7/2002 | |
| WO | WO-9316157 | A1 * | 8/1993 | C11D 1/62 |
| WO | WO 98/23808 | | 6/1998 | |
| WO | WO 99/25797 | | 5/1999 | |
| WO | WO 02/086044 | | 10/2002 | |
| WO | WO 2008/040785 | | 4/2008 | |
| WO | WO 2011/123284 | | 10/2011 | |
| WO | WO 2011/123733 | | 10/2011 | |
| WO | WO 2014/018578 | | 1/2014 | |
| WO | WO 2014/143182 | | 9/2014 | |
| WO | WO 2016/055341 | | 4/2016 | |
| WO | WO 2018/001889 | | 1/2018 | |
| WO | WO 2020/007670 | | 1/2020 | |

OTHER PUBLICATIONS

International Search Report for corresponding PCT/EP2018/074036, filed Sep. 6, 2018.

Written Opinion of the International Semching Authority for corresponding PCT/EP2018/074036, filed Sep. 6, 2018.

International Preliminary Report on Patentability for corresponding PCT/EP2018/074036, filed Sep. 6, 2018.

Cassel, et al., "Original Synthesis of Linear, Branched and Cyclic Oligoglycerol Standards," *Eur. J. Org. Chem.* 2001(5):875-896 (Mar. 2001).

Gooijer, et al., "Water and Energy Consumption in Domestic Laundering Worldwide—A Review," *Tenside Surf. Det.* 53(5):402-409 (2016).

DGF C-V 17a (53) Ph. Em. 2.5.3 Method A, pp. 1-4 (downloaded Mar. 17, 2020).

U.S. Appl. No. 17/257,661, filed Jan. 4, 2021, Neubauer.

Amendment & Response to Office Action for copending U.S. Appl. No. 16/650,344, filed Sep. 15, 2021.

Notice of Allowance for copending U.S. Appl. No. 16/650,344, dated Dec. 28, 2021.

* cited by examiner

MICROEMULSION COMPRISING QUATERNARY AMMONIUM COMPOUND, ESPECIALLY FOR PRODUCTION OF FABRIC SOFTENER FORMULATIONS

CROSS REFERENCE TO RELATED APPLICATIONS

The present application is US national stage of international application PCT/EP2018/074036, which had an international filing date of Sep. 6, 2018, and which was published on Mar. 14, 2019. The PCT application claims the benefit of U.S. provisional application 62/554,918, filed on Sep. 6, 2017. The contents of the provisional application is hereby incorporated by reference in its entirety.

A. FIELD OF THE INVENTION

The invention provides for the use of specific microemulsions, comprising quaternary ammonium compounds, for production of clear fabric softener formulations having improved performance properties and storage stability, and also the corresponding formulations and a process for production thereof.

B. PRIOR ART

WO 2008155075 and WO 2008155073 describe a cosmetic formulation comprising (a) at least one surfactant selected from non-alkoxylated anionic, zwitterionic or amphoteric surfactants, (b) a microemulsion and (c) at least one cationic polymer. A two-stage process is necessary for production of the microemulsions.

US2013/0012423 discloses microemulsions comprising (a) at least one alkyl(oligo)glycoside, (b) at least one cosurfactant different from (a), (c) at least one water-insoluble organic oil, (d) at least one wax, (e) water. The waxes present in the microemulsions are solid at room temperature. Therefore, the microemulsions here too are produced in a two-stage process in which, firstly, the oil phase has to be heated with all oil-soluble components above the melting point of the non-liquid components. In a second step, the aqueous, surfactant-containing phase is then added.

EP 1715833 describes a microemulsion having a mean particle diameter of 5 to 250 nm, comprising (a) 5% to 50% by weight of at least one particular alkyl- and/or alkenyloligoglycoside carboxylic acid salt, (b) 5% to 50% by weight of an oil component and (c) 0% to 15% by weight of mono- and/or polyfunctional alcohols having 1 to 4 carbon atoms, where the sum of components (a) and (b) makes up 10% to 55% by weight of the overall composition.

DE 19755488 describes microemulsions containing (a) 5% to 30% by weight of oil bodies, (b) 5% to 80% by weight of anionic and/or nonionic emulsifiers and (c) 12% to 30% by weight of polyols, with the proviso that the stated amounts together with water add up to 100% by weight.

DE 10 2011 078 382 A1 discloses microemulsions of polysiloxanes containing quaternary ammonium groups, which can be used in washing and cleaning formulations and in fabric softeners. The quaternary polysiloxanes containing ammonium groups are non-biodegradable and of high viscosity, and so the microemulsions have to be produced at elevated temperature. In DE'382, the initially clear microemulsion is mixed with an ester quat (REWOQUAT WE18) in order to obtain a fabric softener. This fabric softener is no longer clear. The microemulsion is added to the fabric softener only in very small amounts and is a performance booster for the REWOQUAT WE18. The microemulsion of DE'382 cannot be used as a fabric softener on its own, but is a preliminary formulation for production of a fabric softener.

U.S. Pat. No. 5,525,245 discloses transparent fabric softeners consisting of a microemulsion.

US 20040014627 discloses fabric softeners comprising a microemulsion as perfume and oil, but these are opaque.

Some prior art patents disclose transparent fabric softener formulations in which the problem cited for lack of transparency is the addition of the perfume. A solution proposed is to process the perfume either together with a co-oil (WO1999025797) or a surfactant (EP1381664) to give a microemulsion and then to incorporate the latter into a fabric softener formulation comprising ester quats. These production processes are very costly and inconvenient.

The prior art approaches to a solution are inadequate for obtaining transparent fabric softener formulations having commercially required performance properties, especially with regard to stability, softness, drying characteristics, viscosity and perfume retention.

It was an object of the invention to overcome at least one of the disadvantages from the prior art. Further objects that are not mentioned explicitly will become apparent from the overall context of the following description, examples and claims.

C. DESCRIPTION OF THE INVENTION

It has been found that, surprisingly, the use of a microemulsion comprising

A) at least one non-silicone-containing quaternary ammonium compound,
B) at least one ester oil or mineral oil,
C) at least one nonionic surfactant, preferably selected from the group consisting of fatty alcohol ethoxylates and glycerol-based surfactants,
D) at least one nonaqueous solvent, preferably a glycol,
E) water.

for production of fabric softener formulations or even as a fabric softener formulation is capable of solving the problem addressed by the invention.

One advantage of the present invention is that the microemulsion is the actual fabric softener. In other words, it can be used on its own in the form of fabric softener formulations, but also be supplemented with further components to give alternative fabric softener formulations. In both cases, clear and storage-stable fabric softener formulations are obtained. By comparison with prior art fabric softener formulations, the following have additionally been found:

improved softness in textiles, especially in textiles produced from cotton materials,
faster drying characteristics in the washed textiles
better perfume retention
improved storage stability of the formulation.

Without being bound to any particular theory, the inventors are of the view that by the use of the microemulsion according to the invention and the specific composition thereof it was enabled that ester oils and mineral oils can be incorporated into fabric softener formulations that could otherwise not be incorporated in pure form or diluted in solvents for lack of compatibility.

A further advantage of the present invention is that the microemulsions, because of their low viscosity, are easy to process and to incorporate into formulations. Simple stirring-in at low temperatures is sufficient, for example not more than 25° C. By comparison with prior art fabric softeners in which ester quats are generally used in the form of a dispersion and first of all have to be melted for the purpose, this constitutes a significant advantage.

In addition, the microemulsions according to the invention can be produced in a one-stage process. The preparation of an oil phase and a water phase which is customary in the prior art, wherein the oil phase is produced at elevated temperature, as a preliminary formulation can be dispensed with.

A further advantage of the present invention is that further very hydrophobic oils such as vegetable oils, which can be chosen freely, can be incorporated in a certain proportion to give a clear formulation and hence can likewise be formulated easily.

Another advantage of the microemulsions according to the invention is that they can be used to produce fabric softener formulations having suitable viscosity without having to add additional thickeners.

In addition, all components used in the microemulsions according to the invention can be biodegradable.

Yet a further advantage of the present invention is that the compositions according to the invention do not need any preservatives.

All conditions such as pressure and temperature, for example, unless stated otherwise, are standard conditions (20° C., 1 bar).

In connection with the present invention, the term "fatty acids" shall especially be understood to mean formic acid, acetic acid, propionic acid, butyric acid, valeric acid, caproic acid, enanthic acid, caprylic acid, pelargonic acid, capric acid, lauric acid, myristic acid, pentadecanoic acid, palmitic acid, margaric acid, stearic acid, nonadecanoic acid, arachic acid, behenic acid, lignoceric acid, cerotic acid, montanic acid, melissic acid, undecylenoic acid, myristoleic acid, palmitoleic acid, petroselic acid, oleic acid, elaidic acid, vaccenic acid, gadoleic acid, eicosenoic acid, cetoleic acid, erucic acid, nervonic acid, linoleic acid, alpha-linolenic acid, gamma-linolenic acid, calendulic acid, punicic acid, alpha-eleostearic acid, beta-eleostearic acid, arachidonic acid, timnodonic acid, clupanodonic acid, cervonic acid, vernolic acid, ricinoleic acid, particular preference being given to those having a chain length of 6 to 24, preferably 6 to 22 and especially 8 to 18 carbon atoms; the same applies to the carbon-based skeleton for the term "fatty alcohols" used in connection with the invention.

Unless stated otherwise, all percentages (%) given are percentages by mass.

The present invention provides fabric softener formulations according to Claim 1, a process for production thereof according to Claim 8, and for the use of the microemulsion according to the invention for production of fabric softener formulations according to Claim 10. Preferred embodiments are claimed in the dependent claims.

The present invention especially provides for the use of a microemulsion comprising components A) at least one non-silicone-containing quaternary ammonium compound, B) at least one ester oil or mineral oil, C) at least one nonionic surfactant, preferably selected from the group consisting of fatty alcohol ethoxylates and glycerol-based surfactants, D) at least one nonaqueous solvent, preferably a glycol, E) water, as or for production of fabric softener formulations.

Microemulsions according to the invention are thermodynamically stable mixtures of components A) to E) and optionally further components.

Microemulsions preferred in accordance with the invention have a domain size of the disperse phase of less than 1000 nm, especially less than 500 nm, the determination of domain size being conducted with the aid of scattering methods known to those skilled in the art, as described, for example, in P. Lindner and Th. Zemb, "Neutrons, X-Rays and Light: Scattering Methods Applied to Soft Condensed Matter", Elsevier Science & Technology, November 2002 or O. Glatter and O. Kratky, "Small-angle X-ray Scattering" Academic Press Inc, December 1982.

A preferred microemulsion of the present invention is characterized in that the components are present as follows:

A) in an amount of 1% by weight to 40% by weight, preferably 1.5% by weight to 30% by weight, more preferably 3% by weight to 25% by weight and very preferably 5% by weight to 20% by weight, B) in an amount of 1% by weight to 60% by weight, preferably 2% by weight to 50% by weight, particularly 3% by weight to 40% by weight, very particularly 5% by weight to 30% by weight, especially preferably 5% by weight to 25% by weight, very especially preferably 5% by weight to 20% by weight and most preferably 8% by weight to 19% by weight, C) in an amount of 0.01% by weight to 50% by weight, preferably 0.1% by weight to 40% by weight, more preferably 0.5% by weight to 30% by weight, very particularly 1% by weight to 20% by weight and most preferably 1% by weight to 10% by weight, D) in an amount of 1% by weight to 50% by weight, preferably 2% by weight to 40% by weight, more preferably 3% by weight to 30% by weight, very particularly 5% by weight to 20% by weight and most preferably 5% by weight to 15% by weight, and E) in an amount of 10% by weight to 80% by weight, preferably 20% by weight to 75% by weight, more preferably 30% by weight to 70% by weight, very particularly 40% by weight to 70% by weight and most preferably 50% by weight to 70% by weight, where the percentages by weight are based on the overall composition of the microemulsion and the amounts of the individual components A) to E) and optionally further components are chosen such that they add up to 100% by weight of the microemulsion in total.

Component A) used may be quaternary ester compounds (ester quats) which may preferably be quaternized fatty acid esters based on mono-, di- or trialkanolamine, preferably mono-, di- or triethanolamine or mono-, di- or tripropanolamine, more preferably mono-, di- or triethanolamine.

Component A) may also be alkylguanidium salts or imidazolinium salts. A preferred composition of the present invention is characterized in that A) is selected from the group of the ester quats and imidazolinium salts, especially the liquid ester quats and liquid imidazolinium salts.

In the context of the present invention, the term "ester quat" is understood to mean a chemical compound containing both a quaternary nitrogen atom and an ester bond in the cationic portion of an ion pair. This is preferably understood to mean a class of surface-active quaternary ammonium compounds having the general formula $R^{11}R^{12}R^{13}R^{14}N^{+}X^{-}$, characterized in that at least one of the $R^{11}$ to $R^{14}$ radicals has more than 4 carbon atoms and is bonded to the charged group via ester bonds C(O) O— or OC(O)—. Preferably, one, more than one but not all or all of the $R^{11}$ to $R^{14}$ radicals are a saturated or unsaturated, straight-chain, branched or cyclic hydrocarbyl radical which is optionally interrupted by oxygen or nitrogen atoms or carboxyl groups and optionally substituted. $X^-$ is understood to mean any anionic counterion.

The composition according to the invention is outwardly neutral with regard to its electrical charge since the charges of the ester quats are neutralized by corresponding counterions X−. Suitable counterions in accordance with the invention are all of those that can compensate for the charge of the quats. Preferably, the counterion $X^-$ in connection with the present invention is selected from the group comprising halogen ions, especially chloride, sulfate, phosphate, methylsulfate, ethylsulfate, methanesulfonate, ethanesulfonate, tosylate, acetate, lactate and citrate.

In the context of the present invention, the term "liquid ester quats" is understood to mean ester quats having, at 1 bar, a melting point of 40° C. or lower, more preferably 25° C. or lower and very preferably 10° C. or lower. If the ester quats present in the composition are mixtures of ester quats, the melting point relates to the melting point of the mixture of all ester quats present in the formulation. The same applies to imidazolinium salts.

Component A) comprises at least one non-silicone-containing quaternary ammonium compound, but may also consist of a mixture of two or more non-silicone-containing quaternary ammonium compounds. Silicone-containing quaternary ammonium compounds are environmentally disadvantageous since they are non-biodegradable. Moreover, when they are used, it is necessary to produce a preliminary formulation owing to their viscosity at elevated temperatures.

Microemulsions comprising mainly silicone-containing quaternary ammonium compounds have a minor thickening effect. In order to obtain aqueous formulations having a viscosity (Brookfield, 25° C.) of 1500 mPas, additional thickeners would have to be added. The microemulsions according to the invention therefore preferably include silicone-containing quaternary ammonium compounds only in a proportion of 0% to 9% by weight, more preferably 0% to 5% by weight, even more preferably of 0% to 2.5% by weight, especially preferably 0% to 1% by weight, very especially preferably 0% to 0.5% by weight, particularly preferably 0% to 0.1% by weight, and most preferably do not contain any silicone-containing quaternary ammonium compounds.

A preferred composition of the present invention is characterized in that

A) is selected from the group of the preferably liquid ester quats consisting of quaternized fatty acid alkanolamine ester salts, more preferably from the groups of the quaternized fatty acid ethanolamine ester salts and the quaternized fatty acid isopropanolamine ester salts, very preferably from the group of the quaternized fatty acid isopropanolamine or fatty acid ethanolamine ester salts based on dimethylmono-, methyldi- or triisopropanolamine or dimethylmono-, methyldi- or triethanolamine.

An especially preferred microemulsion is characterized in that A) is selected from the group of the liquid ester quats comprising compounds of the general formula (I)

general formula (I)

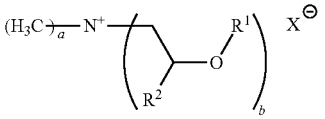

where $R^1$ is an acyl radical of a fatty acid containing one or more, for example two or three, double bonds and having a chain length of 18 to 24 carbon atoms, or the acyl radical of isostearic acid or ricinoleic acid, where $R^2$ is H or an alkyl radical having 1 to 6 carbon atoms, preferably methyl, ethyl, propyl, isopropyl, more preferably methyl and H, and where $X^-$ is a counterion to the positive charge on the quaternary nitrogen group, where doubly or triply negatively charged ions are also to be included here, preferably a halogen ion, especially chloride, sulfate, phosphate, methylsulfate, ethylsulfate, methanesulfonate, ethanesulfonate, tosylate, acetate, lactate or citrate, more preferably methylsulfate or a halogen ion, most preferably methylsulfate, where a=1 to 3 and b=1 to 3, preferably a=1.7 to 2.3 and b=1.7 to 2.3, with the proviso that a+b=4. If b is >1, the $R^1$ radicals may be the same or different.

Ester quats preferred in accordance with Formula (I) of the invention are characterized in that at least one $R^1$ is selected from the acyl radicals of the acids from the group comprising oleic acid, palmitic acid, elaidic acid, vaccenic acid, gadoleic acid, eicosenoic acid, cetoleic acid, erucic acid, nervonic acid, linoleic acid, alpha-linolenic acid, gamma-linolenic acid, calendulic acid, punicic acid, alpha-eleostearic acid, beta-eleostearic acid, arachidonic acid, timnodonic acid, clupanodonic acid and cervonic acid, particular preference being given to oleic acid. It is also possible in accordance with the invention to use mixtures of these carboxylic acids.

Preferred compositions according to the invention comprise at least one compound of the general formula (I) with a=1.7 to 2.3 and b=1.7 to 2.3, more preferably a=b=2.

A composition particularly preferred in accordance with the invention is characterized in that $R^1$ is the acyl radical of oleic acid and a=1.7 to 2.3 and b=1.7 to 2.3, more preferably a=b=2.

A further particularly preferred microemulsion is characterized in that A) is selected from the group of the liquid ester quats comprising compounds of the general formula (II)

general formula (II)

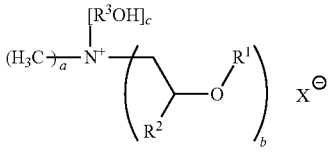

where $R^1$ is an acyl radical of a fatty acid containing one or more, for example two or three, double bonds and having a chain length of 18 to 24 carbon atoms, or the acyl radical of isostearic acid or ricinoleic acid, where $R^2$ is H or an alkyl radical having 1 to 6 carbon atoms, preferably methyl, ethyl, propyl, isopropyl, more preferably H, and where $R^3$ is an alkyl radical having 1 to 6 carbon atoms, preferably methyl, ethyl, propyl, isopropyl, more preferably propyl and ethyl, very preferably ethyl, and where $X^-$ is a counterion to the positive charge on the quaternary nitrogen group, where doubly or triply negatively charged ions are also to be included here, preferably a halogen ion, especially chloride, sulfate, phosphate, methylsulfate, ethylsulfate, methanesulfonate, ethanesulfonate, tosylate, acetate, lactate or citrate, more preferably methylsulfate or a halogen ion, most preferably methylsulfate, where a=1 to 3, b=1 to 3 and c=1 to 3, preferably a=1 or 2, b=1 or 2 and c=1 or 2, more preferred a=1 and b=2 and c=1, with the proviso that a+b+c=4. If b is >1, the $R^1$ radicals may be the same or different.

Ester quats preferred in accordance with Formula (II) of the invention are characterized in that at least one $R^1$ is selected from the acyl radicals of the acids from the group comprising oleic acid, palmitic acid, elaidic acid, vaccenic acid, gadoleic acid, eicosenoic acid, cetoleic acid, erucic acid, nervonic acid, linoleic acid, alpha-linolenic acid, gamma-linolenic acid, calendulic acid, punicic acid, alpha-eleostearic acid, beta-eleostearic acid, arachidonic acid, timnodonic acid, clupanodonic acid and cervonic acid, particular preference being given to oleic acid. It is also possible in accordance with the invention to use mixtures of these carboxylic acids.

A composition particularly preferred in accordance with the invention is characterized in that $R^1$ is the acyl radical of oleic acid, $R^2$ is H, $R^3$ is ethyl and a=1 to 3, b=1 to 3 and c=1 to 3, preferably a=1 or 2, b=1 or 2 and c=1 or 2, more preferred a=1 and b=2 and c=1, with the proviso that a+b+c=4.

Liquid imidazolinium salts likewise present with preference as component A) in microemulsions according to the invention are 1-alkylamidoimidazolinium and 1-alkoxyalkylimidazolinium salts of the general formulae (III) and (IV)

general formula (III)

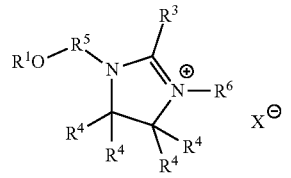

general formula (IV)

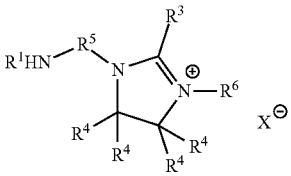

where $R^1$ is an acyl radical as defined for formula (I) or (II), $R^3$ is an optionally branched, optionally unsaturated alkyl radical optionally interrupted by oxygen atoms and having 1 to 30 carbon atoms, preferably a $C_{16}$ to $C_{22}$-alkyl radical having 1 to 3 double bonds, more preferably an oleyl radical, $R^4$ are each independently hydrogen or alkyl, preferably butyl, propyl, ethyl, methyl or hydrogen, more preferably methyl or hydrogen, $R^5$ is a divalent, saturated or unsaturated, straight-chain, branched or cyclic, optionally substituted hydrocarbyl radical having 2 to 6 carbon atoms which is optionally interrupted by oxygen or nitrogen atoms or carboxyl groups, preferably ethylene, $R^6$ is hydrogen or an optionally branched, optionally unsaturated alkyl radical optionally containing oxygen atoms or nitrogen atoms and having 1 to 30 carbon atoms, preferably having 1 to 12 carbon atoms, more preferably having 1 to 4 carbon atoms, especially preferably ethyl or methyl, and $X^-$ is as defined for formula (I) or (II).

The quaternary ammonium compounds described above as preferred and particularly preferred that are used as component A) contribute to the improved performance and production properties shown in the examples. More particularly, liquid quaternary ammonium compounds allow the production of the microemulsions at low temperatures, in a one-stage process. Moreover, the quaternary ammonium compounds used with preference and particular preference make a particular contribution to improved storage stability, to the transparency of the microemulsion and to the thickener properties.

Component B) is an ester oil or mineral oil.

In connection with the present invention, the term "ester oil or mineral oil" is understood to mean water-immiscible liquids suitable for production of fabric softener formulations. In connection with the present invention, "water-immiscible" means that, at room temperature, aqueous mixtures of the oils at oil concentrations of 0.5%-99.5% by volume, based on the overall mixture, lead to cloudiness already perceptible to the human eye or to the formation of two or more phases. In addition, in connection with the present invention, ester oils or mineral oils are preferably characterized in that they have an interfacial tension of >5 mN/m with respect to water. Ester oils or mineral oils may be based, for example, on oleochemistry or silicone chemistry.

Preferably in accordance with the invention, the microemulsions according to the invention include ester oils or mineral oils selected from the group consisting of

- fatty acid esters, preferably esters of linear fatty acids with linear or branched fatty alcohols, esters of branched fatty acids with linear or branched fatty alcohols, esters of linear fatty acids with unbranched or branched polyhydric alcohols, esters of branched fatty acids with unbranched or branched polyhydric alcohols, esters of linear fatty acids with unbranched or branched alcohols, esters of branched fatty acids with unbranched or branched alcohols, esters of alkylhydroxycarboxylic acids with linear or branched fatty alcohols,
- mono-, di- or triglycerides in liquid or solid form,
- fatty alcohol esters, preferably esters of carboxylic acids, aromatic carboxylic acids or dicarboxylic acids with linear or branched fatty alcohols, unbranched or branched polyhydric alcohols or unbranched or branched alcohols,
- linear, cyclic or branched hydrocarbons, with or without substituents, with or without double bonds,
- vegetable oils,
- carbonates with unbranched or branched alcohols, carbonates with unbranched or branched polyhydric alcohols, carbonates with linear or branched fatty alcohols,
- ethers, with or without alkoxy groups,
- silicone oils, with or without organic modification,
- mixtures of the abovementioned oils in any ratios.

As already mentioned above, when silicone oils are used, it is necessary to produce preliminary formulations prior to the production of the microemulsions. Moreover, excessively large amounts can impair the clarity of the microemulsions. It is therefore preferable in accordance with the invention when the microemulsions according to the invention include silicone oils only in a proportion of 0% to 9% by weight, more preferably 0% to 5% by weight, even more preferably of 0% to 2.5% by weight, especially preferably 0% to 1% by weight, very especially preferably 0% to 0.5% by weight, particularly preferably 0% to 0.1% by weight. More particularly, it is also advantageous and therefore preferable when the microemulsions according to the invention do not contain any silicone-containing components at all, i.e. are silicone-free.

More preferably, the following are therefore present as component B):

- esters of linear and/or branched fatty acids with linear and/or branched mono- or polyhydric alcohols, more preferably fatty alcohols,
- mono-, di- or triglycerides in liquid or solid form,
- esters of carboxylic acids, aromatic carboxylic acids or dicarboxylic acids with linear or branched fatty alcohols, unbranched or branched polyhydric alcohols or unbranched or branched alcohols,
- linear, cyclic or branched hydrocarbons, with or without substituents, with or without double bonds,
- vegetable oils, carbonates with unbranched or branched alcohols, carbonates with unbranched or branched polyhydric alcohols, carbonates with linear or branched fatty alcohols, more preferably linear, cyclic or branched hydrocarbons, with or without substituents, with or without double bonds.

Very preferably, the following are present:

- carbonates with unbranched or branched alcohols, carbonates with unbranched or branched polyhydric alcohols, carbonates with linear or branched fatty alcohols, more preferably linear, cyclic or branched hydrocarbons, with or without substituents, with or without double bonds,
- esters of linear and/or branched fatty acids with linear and/or branched mono- or polyhydric alcohols.

According to the invention, component C) is at least one nonionic surfactant.

Preferred non-ionic surfactants are selected from the group comprising, preferably consisting of:

- addition products of ethylene oxide and/or propylene oxide onto linear fatty alcohols, fatty acids, fatty acid amides, fatty amines and alkylphenols,
- glycerol mono- and diesters and sorbitan mono- and diesters of saturated and unsaturated fatty acids and the ethylene oxide addition products thereof,
- alkyl mono-, oligo- and polyglycosides and the ethylene oxide addition products thereof,
- addition products of ethylene oxide onto castor oil and/or hydrogenated castor oil,
- partial esters based on linear, branched, unsaturated and/or saturated fatty acids, ricinoleic acid, 12-hydroxystearic acid, glycerol, polyglycerol, pentaerythritol, dipentaerythritol and sugar alcohols (e.g. sorbitol), alkylglucosides (e.g. methylglucoside, butylglucoside, laurylglucoside) and also polyglucosides (e.g. cellulose), mono-, di- and trialkyl phosphates and also mono-, di- and/or tri-PEG-alkyl phosphates and their salts, citric esters such as glyceryl stearate citrate, glyceryl oleate citrate and dilauryl citrate, for example, and also glyceryl caprylate, polyglyceryl caprylates and polyglyceryl caprates,
- further-alkoxylated triglycerides, mixed ethers and mixed formals, optionally partially oxidized alkyl oligoglycosides or alkenyl oligoglycosides or glucuronic acid derivatives, fatty acid N-alkylglucamides, protein hydrolysates (especially wheat-based plant products), polyol fatty acid esters, sugar esters, polysorbates and amine oxides, and mixtures of these surfactants.

Where the nonionic surfactants contain polyglycol ether chains, they may have a conventional homologue distribution, but preferably a narrowed homologue distribution.

Likewise preferred nonionic surfactants as component C) are polyglycerol esters. The term "polyglycerol esters" in connection with the present invention includes partial polyglycerol esters, and hence compounds in which not all the hydroxyl groups have been esterified.

Preferably in accordance with the invention, the polyglycerol ester of component C) is selected from those of the general formula V general formula V

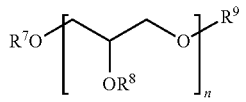

where n=2 to 16, preferably 3-14, more preferably 4-11, and $R^7$, $R^8$, $R^9$=are independently the same or different and are selected from H and saturated or unsaturated, linear or branched acyl radical having 4-36 carbon atoms and optionally containing at least one hydroxyl group, especially selected from the acyl radicals of natural fatty acids.

The polyglycerol esters of the general formula V contain at least one acyl radical per molecule.

$R^7$ is preferably H and the $R^8$ and $R^9$ radicals are preferably H or acyl radicals of natural fatty acids. $R^8$ and $R^9$ may also represent mixtures of such acyl radicals, particularly technical mixtures, for example coconut fatty acid cuts.

For $R^8$ and $R^9$, it is especially preferred that, based on all the $R^8$ and $R^9$ radicals in the polyglycerol ester, at least 50 mol %, preferably at least 75 mol %, of the acyl radicals $R^9$ are selected from capryloyl, caproyl and lauroyl radicals.

The person skilled in the art is aware that the polyglycerol base skeleton present in the general formula V, owing to its polymeric nature, is a random mixture of different compounds. Polyglycerol may have ether bonds formed between two primary, one primary and one secondary or else two secondary positions of the glycerol monomers. For this reason, the polyglycerol base skeleton does not usually consist exclusively of linearly linked glycerol units, but may also comprise branches and rings. For details see, e.g. "*Original synthesis of linear, branched and cyclic oligoglycerol standards*", Cassel et al., *J. Org. Chem.*, 2001, 875-896.

Structures of this kind are covered in the general formula V which has been simplified in this respect.

The degree of polymerization n can be determined by determining the hydroxyl number of the polyglycerol used for synthesis of the inventive ester, where the mean degree of polymerization n is related to the hydroxyl number of the parent polyglycerol via the following equation:

$$n = \frac{\frac{2000 \cdot M(KOH)}{OHN} - M(\text{water})}{\left[[M(\text{glycerol}) - M(\text{water})] - \frac{1000 \cdot M(KOH)}{OHN}\right]}$$

where M=molar mass; OHN=hydroxyl number of the free polyglycerol.

Alternatively, the degree of polymerization n can also be determined by determining the hydroxyl number of the polyglycerol obtained after complete ester hydrolysis.

Suitable methods for determining the hydroxyl number are particularly those according to DGF C-V 17 a (53), Ph. Eur. 2.5.3 Method A and DIN 53240.

Particularly preferred nonionic surfactants are addition products of ethylene oxide and/or propylene oxide onto linear fatty alcohols, fatty acids, fatty acid amides, fatty amines and alkylphenols.

A preferred microemulsion of the present invention is characterized in that a nonaqueous solvent is present as component D), selected from the group comprising, preferably consisting of, hydrotropes, for example from the group of the aliphatic alcohols, such as ethanol, propanol or propane-1,3-diol, cyclic carbonates such as ethylene carbonate, propylene carbonate, glycerol carbonate, esters of mono- or polycarboxylic acids such as ethyl acetate, ethyl lactate, glycerol, isopropyl alcohol, dipropylene glycol, glycol ethers (available, for example, under the DOWANOL® name from Dow Chemicals) and polyols. Polyols which are contemplated here may possess 2 to 15 carbon atoms and at least two hydroxyl groups. Typical examples are: glycerol, alkylene glycols, as for example ethylene glycol, diethylene glycol, propylene glycol, butylene glycol, pentylene glycol, hexylene glycol, 1,2-propanediol, 1,2-butanediol, 1,2-pentanediol, 1,2-hexanediol and also polyethylene glycol or polypropylene glycol, polyhydroxycarboxylic acids, butyl diglycol and mixtures of these solvents.

Especially preferably, the nonaqueous solvent D) is selected from the group consisting of glycerol, glycol, 1,2-propylene glycol, 1,3-propylene glycol, butylene glycol and dipropylene glycol.

The microemulsions of the present invention can advantageously be used for production of or as a fabric softener formulation. Fabric softener formulations according to the invention are suitable for the household or the industrial and institutional sector. They improve, for example, the softness, dry stiffness and electrostatic charging or the drying characteristics of the treated and/or cleaned articles. In these connections, the articles to be cleaned are preferably fabrics or fibres, especially those of a fibre or a textile, specifically the surface of woven textiles, laundry, especially laundry worn close to the body ("underwear"), cushions or carpets.

The use according to the invention may take place, for example, in the form of a process according to the invention for production of fabric softener formulations, characterized by the process steps of:

1) providing a microemulsion according to the invention, 2) mixing it with an aqueous phase, preferably comprising at least one preservative and/or at least one perfume.

The term "preservative" in the context of the present invention is understood to mean an agent which effects preservation with respect to microbial, particularly bacterial, growth.

The present invention thus also further provides the fabric softeners for the household and industry.

Preferred fabric softener formulations according to the invention for the household and industrial and institutional applications, comprising at least one of the microemulsions according to the invention, are laundry detergents, laundry care products, disinfecting laundry detergents, heavy-duty laundry detergents, light-duty laundry detergents, wool laundry detergents, fabric softeners and impregnating agents, particular preference being given to laundry detergents, laundry care products, heavy-duty laundry detergents, light-duty laundry detergents, wool laundry detergents, fabric softeners, impregnating agents, especially fabric softeners.

A fabric softener formulation according to the invention preferably contains the microemulsion according to the invention in an amount of 0.1% by weight to 100% by weight, where the percentages by weight are based on the overall formulation. The remaining mass up to 100% by weight preferably consists of water and/or at least one additive and/or auxiliary selected from the group of the emollients, viscosity regulators, pearlescent additives, dyes, insect repellents, preservatives, perfumes, dyes and defoamers. More particularly, the compositions according to the invention may contain a total of 0.001% to 25% by weight, more preferably 0.01% to 15% by weight, of one or more different additives or auxiliaries.

The perfume used may be any of the fragrances or fragrance mixtures known to be suitable for fabric softeners from the prior art, preferably in the form of a perfume oil. Examples of fragrances or scents are disclosed inter alia in DE 197 51 151 A1, page 4 lines 11-17. More particularly, the compositions according to the invention may contain from 0.01% to 10% by weight, more preferably 0.1% to 5% by weight, based on the overall composition of the composition, of one or more perfumes.

Dyes used may be any dyes known to be suitable for fabric softeners from the prior art, preference being given to water-soluble dyes. Examples of suitable water-soluble commercial dyes are SANDOLAN® Walkblau NBL 150 (manufacturer: Clariant) and Sicovit® Azorubin 85 E122 (manufacturer: BASF). More particularly, the compositions according to the invention may contain from 0.001% to 0.1% by weight, more preferably from 0.002% to 0.05% by weight, of one or more dyes.

As viscosity regulator for reducing the viscosity, the fabric softener may comprise an alkali metal or alkaline earth metal salt, or mixtures thereof, preferably calcium chloride, preferably in an amount of 0.05% to 2% by weight, based on the overall composition of the composition.

As viscosity regulator for increasing the viscosity, the aqueous fabric softener may comprise a thickener known to be suitable from the prior art, preference being given to the polyurethane thickeners known from WO 2007/125005. Examples of suitable thickeners are TEGO® Visco Plus 3030 (manufacturer: Evonik Tego Chemie), Acusol® 880 and 882 (manufacturer: Rohm & Haas), Rheovis® CDE (manufacturer: BASF), Rohagit® KF 720 F (manufacturer: Evonik Röhm GmbH) and Polygel® K100 from Neochem GmbH.

Defoamers used may be any defoamers known to be suitable for fabric softeners from the prior art. Examples of suitable commercial defoamers are Dow Corning® DB-110A and TEGO® Antifoam® 7001 XP. More particularly, the compositions according to the invention may contain from 0.0001% to 0.05% by weight, preferably from 0.001% to 0.01% by weight, of one or more different defoamers.

As preservative, the fabric softener may comprise active bactericidal and/or fungicidal ingredients known to be suitable from the prior art, preference being given to water-soluble active ingredients. Examples of suitable commercial bactericides are methylparaben, 2-bromo-2-nitropropane-1,3-diol, 2-methyl-4-isothiazolin-3-one and 5-chloro-2-methyl-4-isothiazolin-3-one. The aqueous fabric softener may likewise comprise an oxidation inhibitor as preservative. Examples of suitable commercial oxidation inhibitors are ascorbic acid, 2,6-di-tert-butyl-4-methylphenol (BHT), butylhydroxyanisole (BHA), tocopherol and propyl gallate. More particularly, the compositions according to the invention may contain from 0.0001% to 0.5%, more preferably 0.001% to 0.2% by weight, of one or more different preservatives. More particularly, the compositions according to the invention may contain from 0.001% to 0.1% by weight, preferably 0.001% to 0.01% by weight, of one or more different oxidation inhibitors.

One or more of the aforementioned additional components, preferably perfumes, emollients or insect repellents, can, however, also be incorporated into the microemulsion, i.e. be part of the microemulsion. These components may thus be present in the fabric softener formulations of the invention as part of the microemulsion and/or as a separate constituent.

The amounts of the particular additives are guided by the intended use.

Typical guide formulations for the respective applications are known prior art and are contained for example in the brochures of the manufacturers of the particular basic materials and active ingredients. These existing formulations can generally be adopted unchanged. If necessary, the desired modifications can, however, be undertaken without complication by means of simple experiments for the purposes of adaptation and optimization.

The examples adduced hereinafter describe the present invention by way of example, without any intention that the invention, the scope of application of which is apparent from the entirety of the description and the claims, be restricted to the embodiments specified in the examples.

D. PRODUCTION EXAMPLES FOR MICROEMULSIONS

General Instructions:

For production of the microemulsions according to the invention, components A to F were stirred together in the amounts specified in Tables 1 and 2 below at room temperature, without expending much energy. All the amounts stated in the table are percent by mass based on the total mass of the microemulsion. A clear microemulsion was formed in all the inventive examples.

The following components were used:

Component A (Ester Quat):

CARSPRAY 90 (Di-Oleyl Carboxyethyl Hydroxyethyl Methylammonium Methosulfate, Evonik Nutrition & Care GmbH); abbreviated hereinafter to C90

REWOQUAT WE 45 (Di-Oleyl/Palmitoyl Carboxyethyl Hydroxyethyl Methylammonium Methosulfate, Evonik Nutrition & Care GmbH); abbreviated hereinafter to WE 45

REWOQUAT WE 3690-90 (Di-Oleyl/Imidazolium Quat, Evonik Nutrition & Care GmbH); abbreviated hereinafter to WE 3690-90

CARSPRAY 800 (Di-Oleyl Ester Quat, Evonik Nutrition & Care GmbH); abbreviated hereinafter to C800

REWOQUAT CR 3099 (Bis-(Isostearoyl/Oleoyl Isopropyl) Dimonium Methosulfate, Evonik Nutrition & Care GmbH); abbreviated hereinafter to CR 3099

Component B (Ester Oil):

REWOCARE DOC (Diethylhexyl Carbonate, Evonik Nutrition & Care GmbH); abbreviated hereinafter to DOC REWOCARE OT (Iso-octyl Tallow Fatty Acid, Evonik Nutrition & Care GmbH); abbreviated hereinafter to OT 2-ethylhexyl oleate; abbreviated hereinafter to EthO 2-ethylhexyl stearate; abbreviated hereinafter to EthSt Component C (Surfactant):

REWOPAL MPG 40 (Tetraethylene Glycol Monophenyl Ether, Evonik Nutrition & Care GmbH); abbreviated hereinafter to MPG 40

TEGO Alkanol L4 (Laureth-4, Evonik Nutrition & Care GmbH); abbreviated hereinafter to L4

Tegotens EC11 (end-capped fatty alcohol ethoxylate, Evonik Nutrition & Care GmbH); abbreviated hereinafter to EC11

Component D (Solvent):

Butylglycol; abbreviated hereinafter to BG

Diethylene Glycol Butyl Ether; abbreviated hereinafter to DEBE

Glycol n-Butyl Ether; abbreviated hereinafter to PnB

Component E:

water

Component F (Optional Additive):

perfume oil (TH Geyer Ingrediens GmbH@Co)

TABLE 1

| Ex. | Ester quat (comp. A) | | Ester oil (comp. B) | | Surfactant (comp. C) | | Solvent (comp. D) | | Water (comp. E) |
|---|---|---|---|---|---|---|---|---|---|
| no. | Name | Amount | Name | Amount | Name | Amount | Name | Amount | Amount |
| 1 | C 90 | 11.1 | DOC | 10 | MPG 40 | 7 | BG | 7 | 64.9 |
| 2 | C 90 | 11.1 | DOC | 10 | MPG 40<br>L4 | 3<br>4 | BG | 7 | 64.9 |
| 3 | C 90 | 11.75 | EthO | 9.34 | EC 11 | 2.2 | DEBE<br>PnB | 1.96<br>8.72 | 66.03 |
| 4 | C 90 | 6.81 | EthO | 9.77 | EC 11 | 2.2 | DEBE<br>PnB | 2.12<br>9.94 | 66.03 |
| 5 | C 90 | 12.5 | DOC | 10 | MPG 40<br>L4 | 5<br>2 | BG | 7 | 63.5 |
| 6 | C 90 | 15 | DOC | 10 | MPG 40<br>L4 | 5<br>2 | BG | 7 | 61 |
| 7 | C 90 | 11.1 | DOC | 11 | MPG 40<br>L4 | 5<br>2 | BG | 7 | 63.9 |
| 8 | C 90 | 11.1 | DOC | 10 | MPG 40<br>L4 | 3<br>1.2 | BG | 7 | 67.7 |
| 9 | C 90 | 11.1 | DOC | 10 | MPG 40<br>L4 | 2.5<br>1 | BG | 7 | 68.4 |
| 10 | WE 45 | 11.74 | EthO | 9.33 | EC 11 | 2.2 | DEBE<br>PnB | 1.94<br>8.69 | 66.09 |
| 11 | WE 45 | 11.74 | EthSt | 9.33 | EC 11 | 2.2 | DEBE<br>PnB | 1.94<br>8.69 | 66.09 |

TABLE 1-continued

| Ex. | Ester quat (comp. A) | | Ester oil (comp. B) | | Surfactant (comp. C) | | Solvent (comp. D) | | Water (comp. E) |
|---|---|---|---|---|---|---|---|---|---|
| no. | Name | Amount | Name | Amount | Name | Amount | Name | Amount | Amount |
| 12 | WE 3690-90 | 11.1 | DOC | 10 | MPG 40 | 7 | BG | 7 | 64.9 |
| 13 | WE 3690-90 | 11.1 | DOC<br>OT | 9<br>1 | MPG 40 | 7 | BG | 7 | 64.9 |
| 14 | WE 3690-90 | 11.1 | DOC | 10 | MPG 40<br>L4 | 5<br>2 | BG | 7 | 66.09 |
| 15 | C 800 | 16.3 | EthSt | 18.87 | EC 11 | 1.37 | DEBE<br>BG | 4.21<br>5.54 | 53.72 |
| 16 | CR 3099 | 11.1 | DOC | 10 | MPG 40 | 7 | BG | 7 | 64.9 |
| 17 | CR 3099 | 11.1 | DOC<br>OT | 8<br>2 | MPG 40 | 7 | BG | 7 | 64.9 |
| 18 | CR 3099 | 10 | DOC | 10 | MPG 40 | 7 | BG | 7 | 66 |
| 19 | CR 3099 | 10 | DOC | 10 | MPG 40<br>L4 | 5<br>2 | BG | 7 | 66 |

TABLE 2

| Ex. | Ester quat (comp. A) | | Ester oil (comp. B) | | Surfactant (comp. C) | | Solvent (comp. D) | | Water (comp. E) | Perfume oil (comp. F) |
|---|---|---|---|---|---|---|---|---|---|---|
| no. | Name | Amount | Name | Amount | Name | Amount | Name | Amount | Amount | Amount |
| | | | | | MGP 40 | 5 | | | | |
| 20 | C 90 | 11.1 | DOC | 10 | L4 | 2 | BG | 7 | 64.9 | |
| | | | | | MPG 40 | 5 | | | | |
| 21 | C 90 | 11.1 | DOC | 10 | L4 | 2 | BG | 7 | 63.7 | 1.2 |
| | | | | | MPG 40 | 5 | | | | |
| 22 | C 90 | 11.1 | DOC | 10 | L4 | 2 | BG | 7 | 59.9 | 5 |
| | | | | | MPG 40 | 5 | | | | |
| 23 | C 90 | 11.1 | DOC | 10 | L4 | 2 | BG | 7 | 54.9 | 10 |
| | | | | | MPG 40 | 5 | | | | |
| 24 | C 90 | 11.1 | DOC | 10 | L4 | 2 | BG | 7 | 49.9 | 15 |
| | | | | | MPG 40 | 5 | | | | |
| 25 | C 90 | 11.1 | DOC | 10 | L4 | 2 | BG | 7 | 44.9 | 20 |

E. PERFORMANCE PROPERTIES

Formulation constituents are named in the compositions which follow in the form of the commonly acknowledged INCI nomenclature using the English terms. All concentrations in the application examples are given in percent by weight.

E1. Clarity of Fabric Softener Formulations

All the microemulsions from Examples 1 to 25 are clear. Therefore, all the microemulsions were diluted with water in a ratio of 1:1000 or 1:500 in order to simulate the production of a fabric softener formulation. These dilutions show very good stability even over several weeks. In the case of microemulsions 1 to 23, the diluted formulation was clear. The problems addressed by the invention of being able to provide clear fabric softener formulations and to produce these in a low-energy manner at room temperature have thus been solved.

In the case of microemulsions 24 and 25, the diluted formulation was cloudy. However, these microemulsions can be used in non-clear or less diluted fabric softeners.

E2. Use Examples

E2.1 Pretreatment of the Cotton Fabric

Cotton terrycloth fabric (WFK Test Fabric WFK 12 A) of size 80 cm×50 cm with a basis weight of about 350 g/m$^2$ was washed twice with heavy-duty laundry detergent at 40° C., rinsed twice, spun and dried in air hanging on a line in a single ply.

E2.2 Softness

To determine the softening effect of the microemulsions on textiles, the cotton towels were treated therewith.

TABLE 3

| Composition of the fabric softener [% by wt.] | | | | |
|---|---|---|---|---|
| | W1 (inventive) | Comparative example C1 | Comparative example C2 standard commercial clear fabric softener | Comparative example C3 standard commercial fabric softener |
| Microemulsion from Example 20 | 99% by wt. | – | – | – |
| Perfume oil | + | + | – | – |
| REWOQUAT WE 18[1)] | – | 6% by wt. | – | – |
| Dye | + | + | – | – |
| Water | Remainder to 100% by wt. | Remainder to 100% by wt. | – | – |
| Appearance | clear | not clear | clear | not clear |

[1)]Commercial product from Evonik Nutrition & Care GmbH

E2.2.1 Treatment of the Cotton Fabric

The fabric softeners according to Table 3 were each diluted with cold tap water to give a rinse solution that contained 0.025% by weight of textile conditioning-active substances, i.e. the microemulsion in W1 and Rewoquat WE 18 in C1, or, if it is unknown, as in C2 and C3, based on the drying residue.

The cotton towels were immersed in 2 litres of the rinse solution for 10 minutes. It should be ensured here that the towels are wetted homogeneously by the rinse solution. Subsequently, the towels are spun and dried at room temperature hanging on a line in a single ply. The treated cotton terrycloth towels were cut into 10 identical pieces of 16 cm by 25 cm.

E.2.2 Assessment of Softness

To assess softness, an experienced team of 9 individual testers was assembled, who used a hand panel test to evaluate the anonymized hand specimens from E 2.2.1. In this test, each tester receives their own cotton towel. The assessment is made on a scale from 0 (hard and unpleasant feel) to 5 (soft and pleasant feel) with the option of intervening integer values. For the assessment of softness, the individual evaluations were added up, meaning that, with 9 testers, a maximum softness value of 45 is possible.

For the hand specimens, in addition, an untreated sample without obvious marking (blank value) was always included.

The results of the assessment of softness are reported in Table 4.

TABLE 4

Summary of the softness results

| Cotton fabric treated with a clear fabric softener | Softness |
|---|---|
| W1 | 34 |
| C1 | 35 |
| C2 | 16 |
| C3 | 45 |

By comparison with a commercial clear fabric softener (C2), the clear fabric softener formulation according to the invention shows a test result which is more than twice as good. The commercial fabric softener in C3 does show better softness, but is not clear. The fabric softener formulation in C1 shows comparable softness, but is likewise not clear. It has thus been possible for the first time with the formulations according to the invention to produce clear fabric softener formulations having comparable softness to that from non-clear fabric softeners. Since consumers, however, prefer clear fabric softeners, this is a significant technical advance.

In order to find out which quaternary structure gives the best softness results, similar formulations were formulated with different quats and tested as described above.

Nine untrained panel participants were invited to rate the treated substance samples from good to poor. For this purpose, each participant was provided with the cotton fabric treated with the five different fabric softener formulations. The results were then added up, such that it was possible to establish a sequence of the samples. The formulation that received the highest ratings on average received a "1" as softness rating, the second-best formulation a "2". All formulations could be differentiated without difficulty from the blank value.

TABLE 5

Summary of the softness results, 1 = the best, 4 = the worst

| Cotton fabric treated with | Softness rating |
|---|---|
| Blank value | 4 |
| Example 16 | 3 |
| Example 19 | 3 |
| Example 20 | 2 |
| Example 14 | 1 |

Summary of the softness results, 1=best value, 4=worst value. Accordingly, the best results were achieved with an ester quat of formula IV in Example 14, followed by a microemulsion comprising an ester quat of the formula II in Example 20.

E2.3 Perfume Retention

To determine the perfume retention effect of the microemulsions comprising perfume on textiles, cotton towels were treated therewith.

E2.3.1 Treatment of the Cotton Fabric

The above-described microemulsions from Examples 20 and 21 were each diluted with cold tap water to give a rinse solution that contained 0.025% by weight of textile conditioning-active substances from the microemulsion. The cotton towels were immersed in 2 litres of the rinse solution for 10 minutes. It should be ensured here that the towels are wetted homogeneously by the rinse solution. Subsequently, the towels are spun and dried at room temperature hanging on a line in a single ply. The treated cotton terrycloth towels were cut into 10 identical pieces of 16 cm by 25 cm.

E2.3.2 Assessment of Perfume Retention

To assess perfume retention, an experienced team of 11 individual testers was assembled, who used an odour panel test to assess the anonymized odour specimens of the cotton fabric treated with the microemulsions. In this test, each tester receives their own cotton towel. In one odour panel, a maximum of two different cloths were assessed relative to one another. The assessment was made on a scale from 1 (less intense) to 2 (more intense) with the possibility of intermediate integer values in the final total for all testers. For the assessment of odour, the individual evaluations were added up, meaning that, with 11 testers, a maximum value of 22 is possible. The perfume retention assessment is made 24 h after the treatment of the textiles and after 7 days. The results of the assessment by the odour panel are reported in Table 6.

TABLE 6

Summary of the perfume retention results

| Cotton fabrics treated with a clear fabric softener | Perfume retention results after 24 h | Perfume retention results after 7 days |
|---|---|---|
| Example 20 + 1.2% perfume oil | 10 | 11 |
| Example 21 (the perfume oil is incorporated here into the microemulsion) | 17 | 16 |

The results in Table 6 show that the incorporation of the perfume directly into the microemulsion (Example 21) leads to much better results in perfume retention.

E2.4 Quick-Drying Characteristics

To determine the quick-drying action of the microemulsions on textiles, cotton towels were treated therewith.

E2.4.1 Treatment of the Cotton Fabric

Terrycloth (WFK Test Fabric WFK 12 A) was washed with a commercial liquid laundry detergent at 40° C. in accordance with the recommended dosage and then dried on the line. Rectangular 80 g pieces were cut into three pieces of roughly equal size and weighed (mass 1). These pieces of material were then placed into 1 litre of a dispersion that contained 250 ppm (in active form) of the microemulsions for 5 minutes. The pieces of material were turned over and left in the dispersion for a further 5 minutes.

After a total of 10 minutes in the dipping bath, the pieces of material were removed and simultaneously spun in a laundry spin dryer (from Thomas, model: 772 SEK 287) for 60 seconds and weighed again (mass 2), and then dried on the line overnight.

The difference (mass 2−mass 1) corresponds to the amount of the residual moisture content still remaining on the material after treatment with the appropriate formulation. This difference was based on the starting weight of the dry material, such that it was possible to determine a percentage residual moisture content by (mass 2−mass 1)/mass 1. In the experiments, an untreated sample (blank value) was always additionally measured.

This residual moisture content should be minimal in order to use a minimum amount of energy in the subsequent drying of the material (cf. "Water and Energy Consumption in Domestic Laundering Worldwide—A Review" Henk Gooijer and Rainer Stamminger, Tenside Surf. Det. 53 (2016) 5).

TABLE 7

Summary of the quick-drying characteristics

| Cotton fabrics treated with a clear fabric softener | Quick-drying characteristics [% by weight of residual water] |
|---|---|
| Blank value | 58.8 |
| C4: Standard commercial clear fabric softener | 53.2 |
| C5: Standard commercial fabric softener | 55.3 |
| Example 20 | 46.6 |
| Example 14 | 46.4 |
| Example 19 | 47.9 |

Table 7 shows that the fabric softener formulations according to the invention have much better quick-drying characteristics than standard commercial fabric softeners.

E2.5 Properties as Thickener

To test the thickening effect of aqueous composition, microemulsion ME26 was produced as described below and compared with the microemulsion according to example ME21 of DE 10 2011 078 382 A1.

Example ME26: Microemulsion According to the Invention 26.7% TEGOSOFT M (Isopropyl Myristate, Evonik Nutrition & Care GmbH), 13.3% VARISOFT EQ F 75 Pellets (70% Distearoylethyl Hydroxyethylmonium Methosulfate; 30% Cetearyl Alcohol, Evonik Nutrition & Care GmbH), 24% dipropylene glycol and 26.7% TEGOSOFT PC 41 (Polyglyceryl-4 Caprate, Evonik Nutrition & Care GmbH) were stirred in 9.3% water.

A clear microemulsion forms.

For the assessment of the thickener capacities in aqueous formulations, the formulations specified in Table 8 were produced and their viscosity was measured. About 1% active substance was used in each case.

TABLE 8

| Formulation examples | ME26 | ME21 from DE'382 |
|---|---|---|
| Texapon NSO, 28%, BASF, (INCI: Sodium Laureth Sulfate) | 32% | 32% |
| TEGO Betain F 50, 38%, Evonik Nutrition & Care GmbH, (INCI: Cocamidopropyl Betaine) | 8% | 8% |
| UCARE Polymer JR-400, Dow Chemicals, (INCI: Polyquaternium-10) | 0.3% | 0.3% |
| ANTIL 171, Evonik Nutrition & Care GmbH, (INCI: PEG-18 Glyceryl Oleate/Cocoate) | 2.5% | 2.5% |
| NaCl | 0.2% | 0.2% |
| Water, demineralized | ad 100.0% | |
| Citric acid (10% solution in water) | ad pH 5.5 ± 0.3 | |
| Microemulsion of example ME26 (inventive) | 2.8 | — |
| Microemulsion of example ME21 of DE'382 (non-inventive) | — | 3.1 |
| VISCOSITY (Brookfield, 25° C., in mPa · s) | 1500 | 110 |

The formulation comprising the inventive microemulsion ME26 shows much higher viscosity than the formulation comprising the microemulsion according to DE'382.

The invention claimed is:

1. A fabric softener formulation comprising a microemulsion, wherein the microemulsion comprises Components A-E as follows:

Component A comprising at least one non-silicone-containing quaternary ammonium compound selected from the group consisting of a liquid ester quat and a liquid imidazolinium salt having, at 1 bar, a melting point of 40° C. or lower, and constituting 1% by weight to 40% by weight of the total microemulsion;

Component B comprising at least one ester oil or mineral oil and constituting 1% by weight to 45% by weight of the total microemulsion;

Component C comprising at least one nonionic surfactant and constituting 0.01% by weight to 50% by weight of the total microemulsion;

Component D comprising at least one nonaqueous solvent and constituting 1% by weight to 50% by weight of the total microemulsion; and Component E comprising water and constituting 40-80% by weight of the total microemulsion;

wherein:

the amounts of the individual Components A to E, and optionally further components, are chosen such that they add up to 100% by weight of the total microemulsion;

when diluted with water in a ratio of 1:1000 or 1:500, the microemulsion remains in the form of a microemulsion;

and the microemulsion does not contain any silicone-containing components.

2. The fabric softener formulation of claim 1, wherein the components of the microemulsion are present in the following amounts:

Component A: 3% by weight to 25% by weight;
Component B: 3% by weight to 40% by weight;
Component C: 0.5% by weight to 30% by weight;
Component D: 3% by weight to 30% by weight
Component E: 50% by weight to 70% by weight.

3. The fabric softener formulation of claim 1, wherein the components of the microemulsion are present in the following amounts:

Component A: 5% by weight to 20% by weight;
Component B: 8% by weight to 25% by weight;
Component C: 1% by weight to 10% by weight;
Component D: 5% by weight to 15% by weight.

4. The fabric softener formulation of claim 1, wherein Component A contains no quaternary ammonium compounds other than liquid ester quats and/or liquid imidazolinium salts.

5. The fabric softener formulation of claim 4, wherein Component A is a quaternized fatty acid alkanolamine ester salt.

6. The fabric softener formulation of claim 4, wherein Component A is a quaternized fatty acid ethanolamine ester salt or a quaternized fatty acid isopropanolamine ester salt.

7. The fabric softener formulation of claim 4, wherein Component A is a compound of general formula (I):

general formula (I)

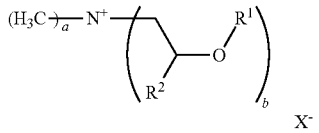

wherein:

$R^1$ is an acyl radical of a fatty acid containing one or more double bonds and having a chain length of 18 to 24 carbon atoms, or the acyl radical of isostearic acid or ricinoleic acid;

$R^2$ is H or an alkyl radical having 1 to 6 carbon atoms; and $X^-$ is a counterion to the positive charge on the quaternary nitrogen group and may optionally be a doubly or triply negatively charged ion;

a=1 to 3 and b=1 to 3;

with the proviso that a+b=4, where, if b>1, the $R^1$ radicals may be the same or different.

8. The fabric softener formulation of claim 7, wherein:

$R^2$ is H or a methyl group;

$X^-$ is methylsulfate or a halogen ion;

a=1.7 to 2.3 and b=1.7 to 2.3.

9. The fabric softener formulation of claim 4, wherein Component A is a compound of general formula (II):

general formula (II)

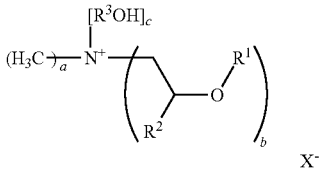

where wherein:

$R^1$ is an acyl radical of a fatty acid containing one or more double bonds and having a chain length of 18 to 24 carbon atoms, or the acyl radical of isostearic acid or ricinoleic acid;

$R^2$ is H or an alkyl radical having 1 to 6 carbon atoms;

$R^3$ is an alkyl radical having 1 to 6 carbon atoms;

$X^-$ is a counterion to the positive charge on the quaternary nitrogen group, and may optionally be a doubly or triply negatively charged ion;

a=1 to 3, b=1 to 3 and c=1 to 3;

with the proviso that a+b+c=4, where, if b>1, the $R^1$ radicals may be the same or different.

10. The fabric softener formulation of claim 9, wherein:

$R^2$ is methyl, ethyl, propyl, or isopropyl;

$R^3$ is methyl, ethyl, propyl, or isopropyl;

$X^-$ is chloride, sulfate, phosphate, methylsulfate, ethylsulfate, methanesulfonate, ethanesulfonate, tosylate, acetate, lactate or citrate;

a=1 or 2, b=1 or 2 and c=1 or 2.

11. The fabric softener formulation of claim 9, wherein:

$R^2$ is H;

$R^3$ ethyl;

$X^-$ is methylsulfate;

a=1, b=2 and c=1.

12. The fabric softener formulation of claim 4, wherein Component A is a liquid imidazolinium salt of general formula (III) or (IV):

general formula (III)

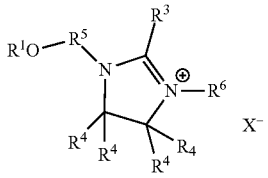

general formula IV

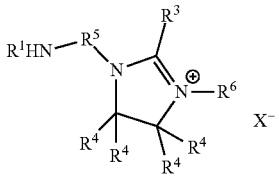

wherein:

$R^1$ is an acyl radical of an at least monounsaturated fatty acid having a chain length of 18 to 24 carbon atoms;

$R^3$ is an optionally branched, optionally unsaturated alkyl radical, optionally interrupted by oxygen atoms and having 1 to 30 carbon atoms;

$R^4$ are each independently hydrogen or alkyl;

$R^5$ is a divalent, saturated or unsaturated, straight-chain, branched or cyclic, optionally substituted, hydrocarbyl radical having 2 to 6 carbon atoms which is optionally interrupted by oxygen or nitrogen atoms or carboxyl groups;

$R^6$ is hydrogen or an optionally branched, optionally unsaturated alkyl radical optionally containing oxygen atoms or nitrogen atoms and having 1 to 30 carbon atoms;

$X^-$ is a counterion to the positive charge on the quaternary nitrogen group.

13. The fabric softener formulation of claim 12, wherein:

$R^3$ is a $C_{16}$ to $C_{22}$ alkyl radical having 1 to 3 double bonds;

$R^4$ are each independently butyl, propyl, ethyl, methyl or hydrogen;

$R^5$ is ethylene;

$R^6$ is hydrogen or an optionally branched, optionally unsaturated alkyl radical optionally containing oxygen atoms or nitrogen atoms and having 1 to 4 carbon atoms;

$X^-$ is methylsulfate or a halogen ion.

14. The fabric softener formulation of claim 1, wherein component B is selected from the group consisting of:

esters of linear and/or branched fatty acids with linear and/or branched mono- or polyhydric alcohols;

mono-, di- or triglycerides in liquid or solid form;

esters of carboxylic acids, aromatic carboxylic acids or dicarboxylic acids with linear or branched fatty alcohols, unbranched or branched polyhydric alcohols or unbranched or branched alcohols;

linear, cyclic or branched hydrocarbons, with or without substituents, with or without double bonds;

vegetable oils;

carbonates with unbranched or branched alcohols, carbonates with unbranched or branched polyhydric alcohols, carbonates with linear or branched fatty alcohols, linear, cyclic or branched hydrocarbons, with or without substituents, with or without double bonds.

15. A process for producing a fabric softener formulation, comprising:

a) providing a microemulsion comprising Components A to E, wherein Components A to E are as defined in claim 1;

b) mixing the microemulsion from step a) with an aqueous phase.

16. The process of claim 15, wherein the components of the microemulsion are present in the following amounts:

Component A: 3% by weight to 25% by weight;
Component B: 3% by weight to 40% by weight;
Component C: 0.5% by weight to 30% by weight;
Component D: 3% by weight to 30% by weight;
Component E: 50% by weight to 70% by weight.

17. The process of claim 16, wherein Component A contains no quaternary ammonium compounds other than liquid ester quats and/or liquid imidazolinium salts.

18. The process of claim 16, wherein Component A is a quaternized fatty acid alkanolamine ester salt.

19. The process of claim 16, wherein Component A is a quaternized fatty acid ethanolamine ester salt or a quaternized fatty acid isopropanolamine ester salt.

* * * * *